US006045342A

United States Patent [19]

Kimura

[11] Patent Number: 6,045,342

[45] Date of Patent: Apr. 4, 2000

[54] REFRIGERANT COMPRESSOR

[75] Inventor: Kazuya Kimura, Kariya, Japan

[73] Assignee: Kabushiki Kaisha Toyoda Jidoshokki Seisakusho

[21] Appl. No.: 09/028,680

[22] Filed: Feb. 24, 1998

[30] Foreign Application Priority Data

Feb. 25, 1997 [JP] Japan ..... 9-041077

[51] Int. Cl.[7] ..... F04B 11/00

[52] U.S. Cl. ..... 417/540; 417/269; 417/450; 91/499

[58] Field of Search ..... 417/269, 450, 417/540, 222.1, 222.2; 91/499

[56] References Cited

U.S. PATENT DOCUMENTS 4,101,249 7/1978 Nakayama et al. ..... 417/269
4,101,250 7/1978 Nakayama et al. ..... 417/269
4,583,922 4/1986 Iijima et al. ..... 417/269
5,533,870 7/1996 Takenaka et al. ..... 417/269
5,556,260 9/1996 Takenaka et al. .
5,674,054 10/1997 Ota et al. ..... 417/269
5,800,147 9/1998 Arai et al. ..... 417/269

*Primary Examiner*—Teresa Walberg
*Assistant Examiner*—Leonid Fastovsky
*Attorney, Agent, or Firm*—Morgan & Finnegan, L.L.P.

[57] ABSTRACT

A compressor has a cylinder bore in a housing. The cylinder bore receives gas from a suction port and discharge the gas out of the compressor through a discharge port. A suction valve is provided with the suction port through which the gas flows with pulsation. A passage communicates the suction port. The pulsation is absorbed when the gas flows within the passage.

16 Claims, 7 Drawing Sheets

REFRIGERANT COMPRESSOR

BACKGROUND OF THE INVENTION

The present invention relates to compressors that are used in vehicle air conditioners.

A typical vehicle air conditioner has a refrigerant circuit, which includes a compressor, an evaporator and other devices. The evaporator, which lowers the temperature of the passenger compartment, is connected to an inlet of the compressor by a suction pipe. The compressor compresses refrigerant gas by reciprocating pistons in cylinder bores. The compressor also includes a valve plate, which has suction ports and discharge ports. Each suction port has a suction valve flap and each discharge port has a discharge valve flap. Each flap selectively opens and closes the corresponding port. Specifically, as a piston reciprocates, refrigerant gas is drawn into the cylinder bore through the associated suction port while causing the associated suction valve flap to flex to an open position. The refrigerant gas is then compressed in the cylinder bore and discharged through the associated discharge port while causing the associated discharge valve flap to flex to an open position.

When the compressor is operating, the suction valve flaps are opened and closed quickly. In other words, the suction valve flaps vibrate. The vibration of the flaps generates suction pulsation of refrigerant gas that is drawn into the compressor. The suction pulsation is transmitted to the evaporator through the suction pipe. This causes the suction pipe and the evaporator to vibrate and produce noise.

Especially, a high frequency component of the suction pulsation causes the evaporator to produce annoying noise. Further, the evaporator is often located next to the front end of the passenger compartment. In this case, the noise may be transmitted to the passenger compartment.

In order to suppress suction pulsation, some prior art compressors include a suction muffler having a great volume in the housing. Other compressors are connected to an evaporator with a muffler having a large volume in between.

However, a large volume suction muffler enlarges the size of the compressor and increases suction pressure loss. Also, a muffler on the suction pipe complicates the piping of the refrigeration circuit and increases the number of parts in the circuit.

SUMMARY OF THE INVENTION

Accordingly, it is an object of the present invention to provide a compressor that reduces high frequency component of suction pulsation without enlarging the size of the compressor or increasing suction pressure loss thereby reducing the level of noise generated by a suction pipe and an evaporator.

To achieve the foregoing and other objectives and in accordance with the purpose of the present invention a compressor having a cylinder bore in a housing is provided. The cylinder bore is arranged to receive gas from a suction port. The compressor includes passage means having a length and communicating the suction port.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A single headed-piston type compressor according to a first embodiment of the present invention will now be described with reference to FIGS. 1 to 5.

Figure 1:
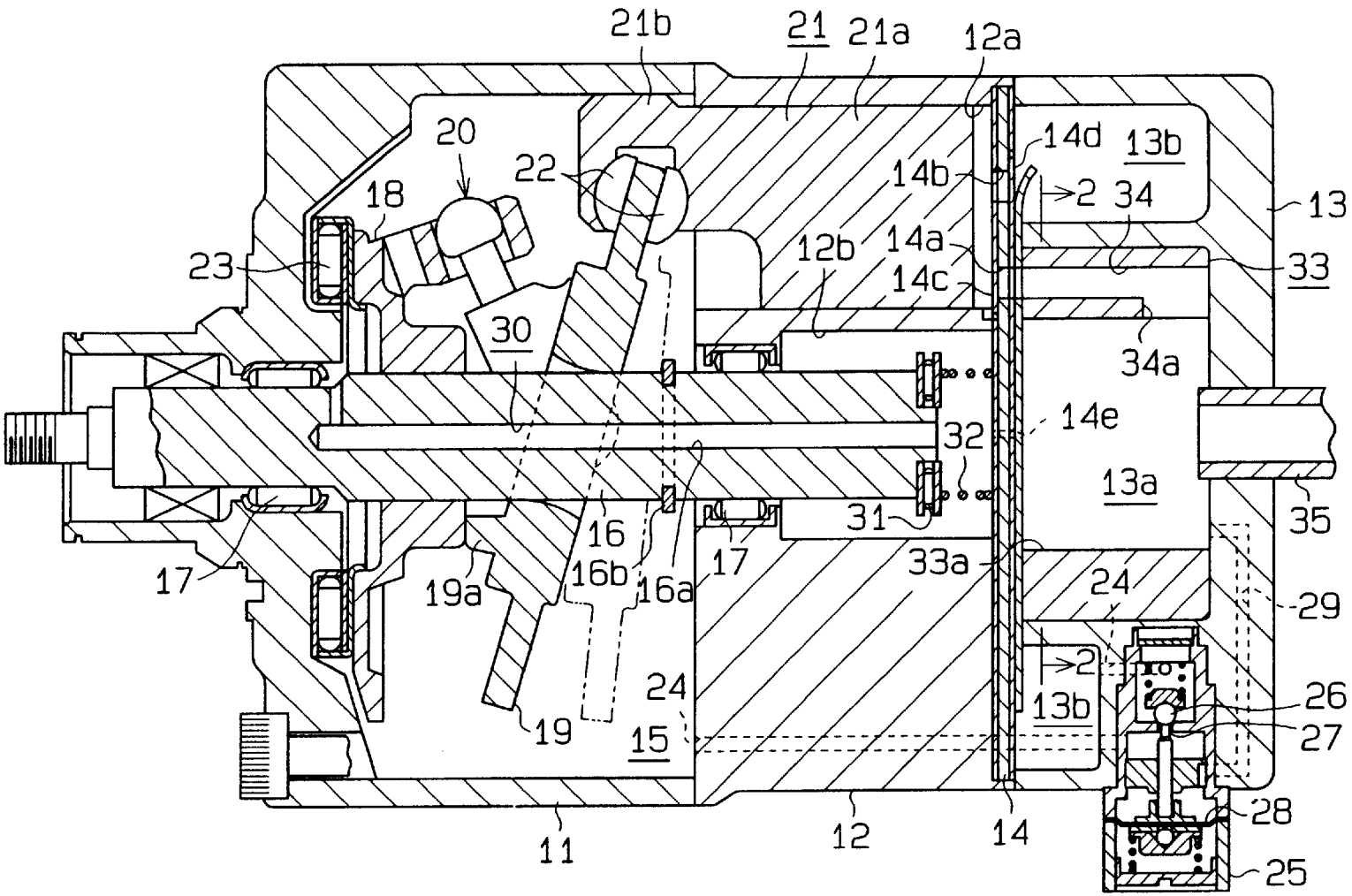
FIG. 1 is a cross-sectional view illustrating a compressor according to a first embodiment of the present invention.

As shown in FIG. 1, the housing of the compressor includes a front housing 11, a cylinder block 12 and a rear housing 13. The front housing 11 is secured to the front end face of the cylinder block 12, whereas the rear housing 13 is secured to the rear end face of the cylinder block 12.

The rear housing 13 includes a suction chamber 13*a* and a discharge chamber 13*b*. A valve plate 14 having suction flaps 14*c* and discharge flaps 14*b* is located between the rear housing 13 and the cylinder block 12. The front face of the cylinder block 12 and the front housing 11 define a crank chamber 15. The crank chamber 15 accommodates a drive shaft 16 that extends through the crank chamber 15 between the front housing 11 and the cylinder block 12. The drive shaft 16 is rotatably supported by a pair of bearings 17 located in the front housing 11 and in the cylinder block 12.

A rotor 18 is fixed to the drive shaft 16. A swash plate 19 is supported on the drive shaft 16 in the crank chamber 15. The swash plate 19 slides along and tilts with respect to axis of the drive shaft 16. The swash plate 19 is coupled to the rotor 18 by a hinge mechanism 20. The hinge mechanism 20 guides the axial and tilting movements of the swash plate 19. The hinge mechanism 20 also causes the swash plate 19 to rotate integrally with the drive shaft 16.

The swash plate 19 has a stopper 19*a* protruding forward from the front surface. The abutment of the stopper 19*a* against the rotor 18 determines the maximum inclination position of the swash plate 19. The drive shaft 16 has a stopper ring 16*b* located between the swash plate 19 and the cylinder block 12. The abutment of the swash plate 19 against the stopper ring 16*b* restricts further inclination of the swash plate 19 and thus determines the minimum inclination position of the swash plate 19.

The cylinder block 12 also includes cylinder bores 12*a*, which are spaced apart at equal angular intervals about the axis of the drive shaft 16. Each cylinder bore 12*a* houses a single-headed piston 21. The pistons 21 reciprocated in the cylinder bores 12*a*. Each piston 21 has a rear portion, or a head 21*a*, and a front portion, or a skirt 21*b*. The head 21*a* of each piston 21 is slidably accommodated in the associated cylinder bore 12*a*. The skirt 21*b* of each piston 21 has a slot facing the swash plate 19. Each slot receives the semispherical surface of a shoe 22. The periphery of the swash plate 19 is fitted into the slot of each piston skirt 21*b* and is slidably held between the flat portions of an associated pair of the shoes 22.

A thrust bearing 23 is located between the rotor 18 and the front wall of the front housing 11. The front housing 11 receives the reaction force that acts on each piston 21 during compression of the gas by way of the shoes 22, the swash plate 19, the hinge mechanism 20, the lug plate 18, and the thrust bearing 23.

The suction chamber 13*a* is connected with the crank chamber 15 by a supply passage 24 extending through the cylinder block 12, the valve plate 14, and the rear housing 13. The rear housing 13 accommodates a displacement control valve 25 that regulates the supply passage 24. The control valve 25 has a valve hole 27, a valve body 26 faced toward the valve hole 27, and a diaphragm 28 for adjusting the opened area of the valve hole 27. The diaphragm 28 is exposed to the pressure (suction pressure) in the suction chamber 13*a* by a pressure communicating passage 29, which displaces the diaphragm 28. Accordingly, the diaphragm 28 moves the valve body 26 and adjusts the opening between the valve hole 27 and the valve body 26.

The control valve 25 alters the amount of refrigerant gas flowing into the crank chamber 15 through the supply passage 24 from the discharge chamber 13*b* and adjusts the pressure Pc of the crank chamber 15. Changes in the pressure Pc of the crank chamber 15 alter the difference between the pressure Pc of the crank chamber 15 acting on the bottom surface of each piston 21 (the left surface as viewed in FIG. 1) and the pressure of the associated cylinder bore 12*a* acting on the head surface of the piston 21 (the right surface as viewed in FIG. 1). The inclination of the swash plate 19 is altered in accordance with changes in the pressure difference. This, in turn, alters the stroke of the piston 21 and varies the displacement of the compressor.

The crank chamber 15 is connected to the suction chamber 13*a* by a gas relieving passage 30. The relieving passage 30 includes an axial passage 16*a* extending through the center of the drive shaft 16, a retaining bore 12*b* defined in the center of the cylinder block 12 and a bore 14*e* extending through the valve plate 14. A radial inlet of the axial passage 16*a* is connected with the crank chamber 15 at the vicinity of the front radial bearing 17. The relieving passage 30 constantly releases a certain amount of refrigerant gas from the crank chamber 15 to the suction chamber 13*a*.

The retaining bore 12*b* accommodates a thrust bearing 31 and a coil spring 32 between the rear end of the drive shaft 16 and the valve plate 14.

A construction for suppressing suction pulsation, which is produced by vibration of the suction valve flaps 14*c*, will now be described.

Figure 3:
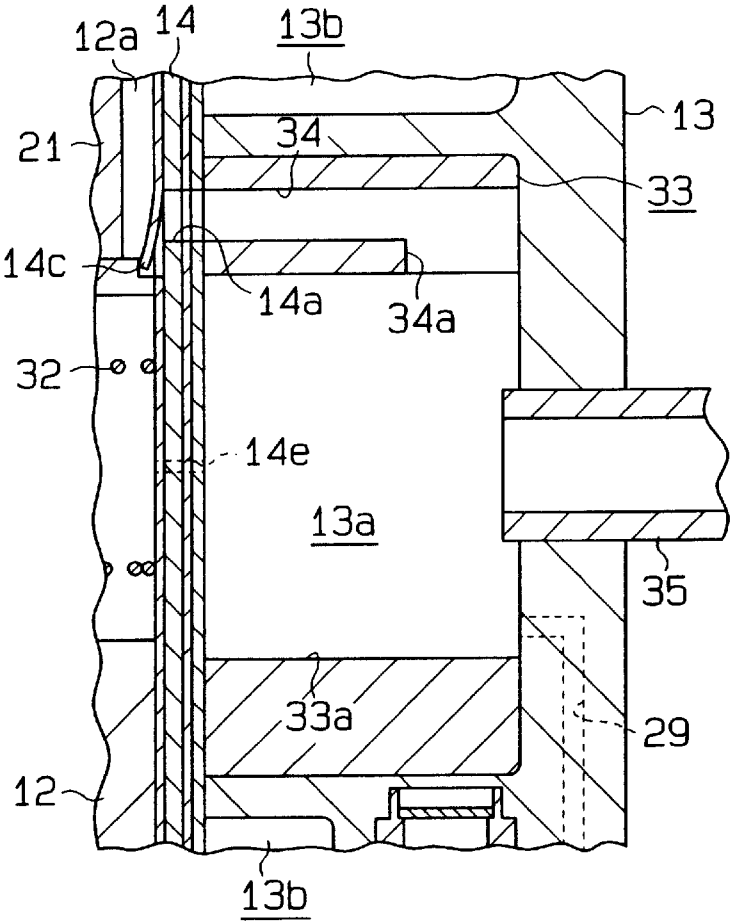
FIG. 3 is an enlarged partial cross-sectional view illustrating the compressor of FIG. 1.
Figure 2:
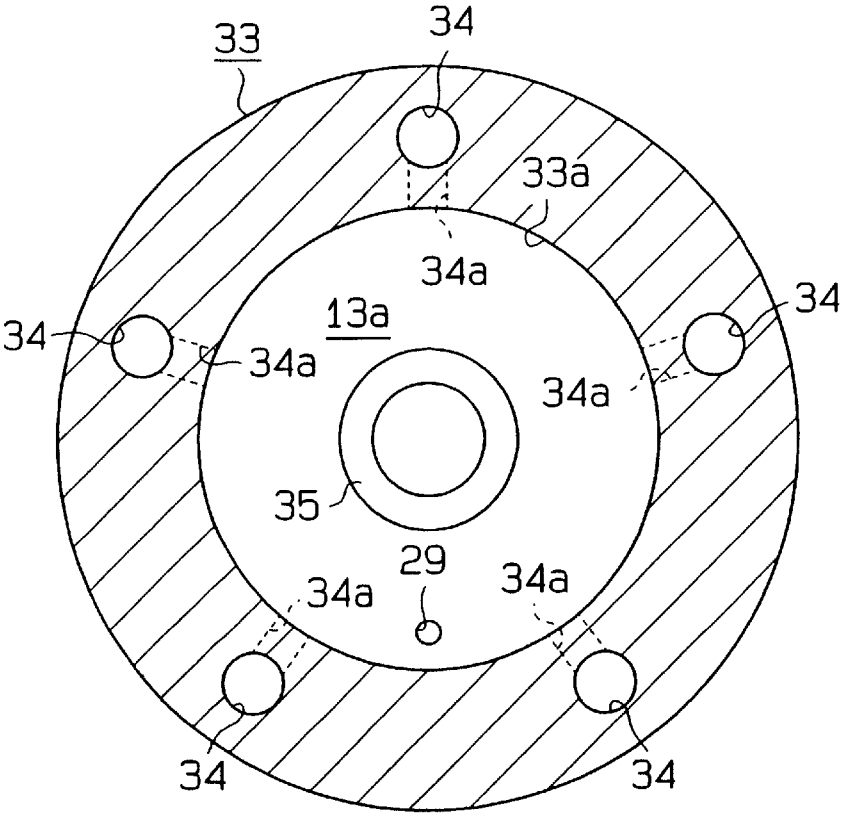
FIG. 2 is a cross-sectional view taken along line 2—2 of FIG. 1.

As illustrated in FIGS. 1 to 3, a cylinder 33 is press fitted in the suction chamber 13*a* of the rear housing 13. The cylinder 33 has extension passages 34 that are spaced apart at equal intervals. Each passage 34 communicates with one of the suction ports 14*a* thereby extending the corresponding suction port 14*a*.

As shown in FIG. 3, the rear end of each passage 34 is communicated with the suction chamber 13*a* by a communication hole 34*a*. The suction chamber 13*a* is connected to one end of a suction pipe 35. The other end of the suction pipe 35 is connected to an evaporator (not shown) in the refrigerant circuit. In other words, the extension passages 34 are connected to the suction pipe 35 with the suction chamber 13*a* in between.

The operation of the above variable displacement compressor will now be described.

The drive shaft 16 is rotated by an external drive source such as a vehicle engine. The swash plate 19 is integrally rotated with the drive shaft 16 by the rotor 18 and the hinge mechanism 20. The rotation of the swash plate 19 is converted to linear reciprocation of the head 21*a* of each piston 21 in the associated cylinder bore 12*a* by the shoes 22. As the head 21 of each piston 21 reciprocates in the associated cylinder bore 12*a*, refrigerant gas in the suction chamber 13*a* enters each cylinder bore 12*a* through the associated suction port 14*a* while causing the associated suction valve flap 14*c* to flex to an open position. The gas in the cylinder bore 12*a* is then compressed to a predetermined pressure and is discharged into the discharge chamber 13*b* through the associated discharge flap 14*b* while causing the associated discharge valve flap 14*d* to flex to an open position.

During operation of the compressor, if the cooling demand becomes great and the load applied to the compressor increases, high pressure Ps in the suction chamber 13*a* acts on the diaphragm 28 of the control valve 25 causing the valve body 26 to close the valve hole 27. This closes the supply passage 24 and stops the flow of highly pressurized refrigerant gas from the discharge chamber 13*b* to the crank chamber 15. In this state, the refrigerant gas in the crank chamber 15 is released into the suction chamber 13*a* through the relieving passage 30. This decreases the pressure Pc of the crank chamber 15. Thus, the difference between the crank chamber pressure Pc and the pressure in the cylinder bores 12*a* becomes small. As a result, the swash plate 19 is moved to the maximum inclination position, as shown by the solid lines in FIG. 1, and the stroke of the piston 21 becomes maximum. In this state the displacement of the compressor is maximum.

If the cooling demand decreases and the load applied to the compressor decreases, low pressure Ps in the suction chamber 13*a* acts on the diaphragm 28 of the control valve 25 and causes the valve body 26 to open the valve hole 27. This communicates the highly pressurized refrigerant gas in the discharge chamber 13*b* to the crank chamber 15 through the supply passage 24 and increases the pressure Pc of the crank chamber 15. Thus, the difference between the crank chamber pressure Pc and the pressure in the cylinder bores 12*a* becomes large. As a result, the swash plate 19 moves toward the minimum inclination position and decreases the stroke of the piston 21. In this state the displacement of the compressor becomes small.

As described above, the opening of the control valve 25 is changed in accordance with the cooling load, or the suction pressure Ps thereby changing the crank chamber pressure Pc. Accordingly, the inclination of the swash plate 19 is varied.

When the above variable displacement compressor is operating, vibration of the suction valve flaps 14*c* generates suction pulsation. However, high frequency components of the suction pulsation are suppressed by the cooperation of the extended suction ports 14*a*, 34 and the suction chamber 13*a*.

If the length of each extended suction port 14*a*, 34 is relatively short in relation to the wavelength of a target frequency component to be suppressed, the suction port 14*a* can be regarded as a coil in an electrical circuit. Also, on the supposition that the suction chamber 13*a* has a cubic shape, if the length of a side is sufficiently short in relation to the wavelength of the target frequency component, the suction chamber 13*a* can be regarded as a capacitor in an electrical circuit. In other words, the transmission path of the suction pulsation can be described as an electrical circuit illustrated in FIG. 4.

Extending the suction ports 14*a* is equivalent to increasing the inductance of the coil. A coil that has a greater inductance attenuates high frequencies by a greater amount. In the same manner, the extended suction ports 14*a*, 34 suppress a high frequency component of the suction pulsation by a greater amount.

Figure 4:
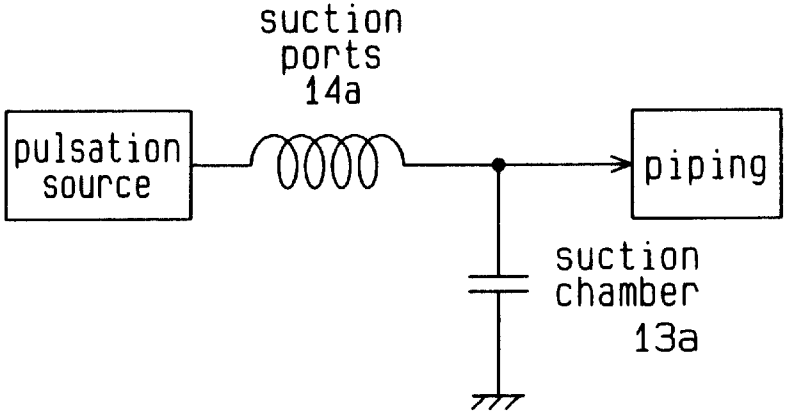
FIG. 4 is a schematic diagram illustrating a path of suction pulsation.

Further, in this embodiment, the suction chamber 13*a* is located between the extension passages 34 and the suction pipe 35. As shown in FIG. 4, the suction chamber 13*a* functions as a capacitor, which has a certain capacitance. Thus, the suction chamber 13*a* suppresses a high frequency component that is not suppressed by the passages 34 in a mechanism that has an effect similar to the high frequency bypass effect of a capacitor.

Figure 5:
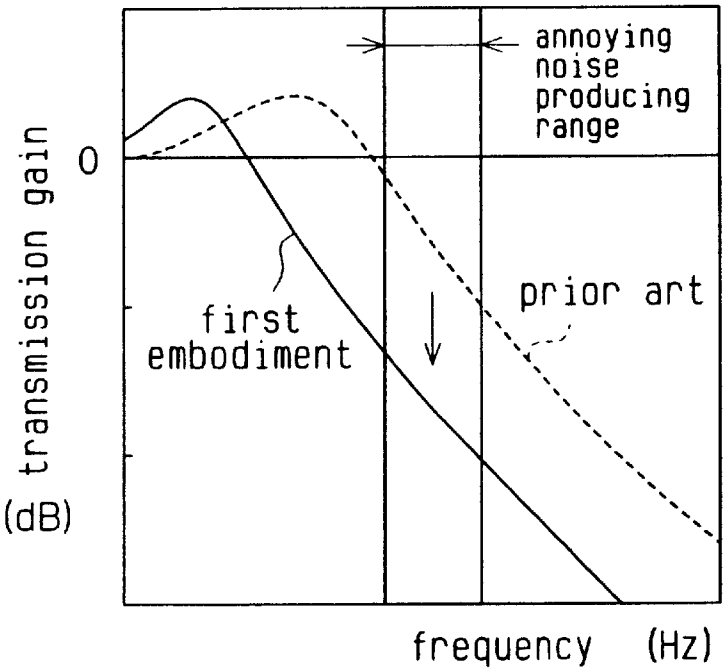
FIG. 5 a graph showing the relationship between transmission gain and frequency of suction pulsation.

An experiment was conducted for comparing the pulsation reduction of the prior art compressor and the compressor of FIGS. 1 to 3. FIG. 5 is a graph showing the relationship between the frequency and the transmission gain of suction pulsation in the compressors. As shown in FIG. 5, the compressor of FIGS. 1 to 3 suppresses the transmission gain of the suction pulsation in a wide frequency range. Specifically, the compressor of FIGS. 1 to 3 suppresses the pulsation at a frequency range that causes the suction pipe and the evaporator to generate annoying noise.

The embodiment of FIGS. 1 to 3 has the following advantages.

The suction ports 14*a* are extended by the passages 34. This construction reduces a high frequency component of suction pulsation, which is caused by vibration of the suction valve flaps 14*c* during operation of the compressor. Thus, the suction pipe 35 and the evaporator are not vibrated as in the prior art. Noise generated by vibration of the pipe 35 and the evaporator is suppressed. As a result, the noise in the passenger compartment is reduced.

This compressor design eliminates the necessity for a suction muffler having a large volume in the compressor housing or a muffler connected to the suction pipe. This design therefore reduces the size of the compressor and suction pressure loss. Also, the piping of the refrigerant circuit is simplified.

The suction chamber 13*a* is connected at the rear end of each passage 34. The cooperation of the extended suction ports 14*a* and the suction chamber 13*a* effectively reduces the high frequency component of the suction pulsation.

The suction ports 14*a* directly communicate with the suction chamber 13*a*, which is defined in the rear housing 13. This construction equalizes the amount of gas that enters the cylinder bores 12*a* thereby reducing the suction pressure loss.

The suction ports 14*a* are extended by simply connecting the passages 34 to the ports 14*a*. In other words, the high frequency component of the suction pulsation is reduced by a simple construction.

The passages 34 are formed in the cylinder 33, which is separately formed from the rear housing 13. Therefore, the length of the passages 34 is easy to adjust in accordance with the frequency of the pulsation component to be reduced.

A second embodiment according to the present invention will now be described. Parts differing from the first embodiment will now be described in detail.

Figure 6:
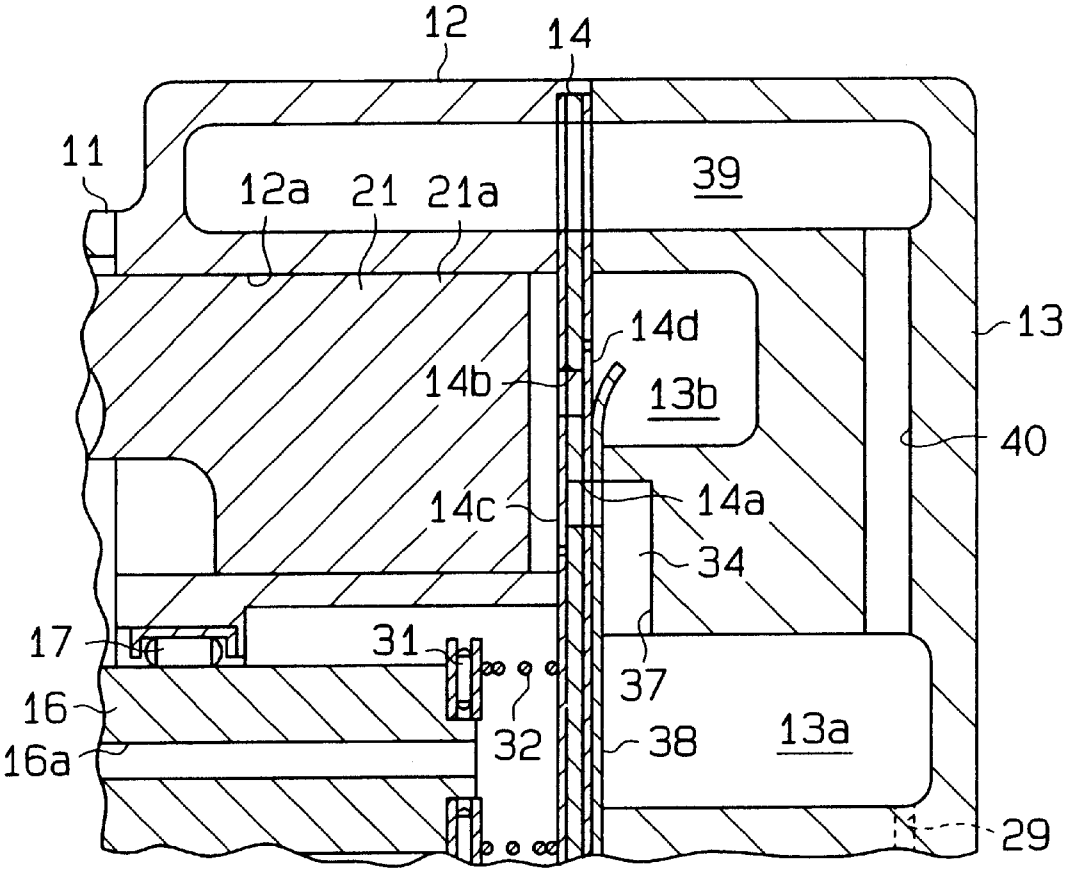
FIG. 6 is an enlarged partial cross-sectional view illustrating a compressor according to a second embodiment.

As shown in FIG. 6, extension passages 34 are formed in the rear housing 13. Each passage 34 is connected to one of the suction ports 14*a*. The passages 34 are defined by radial grooves 37 formed on the rear housing 13 and a gasket 38 located on the valve plate 14. The inner end of each passage 34 communicates with the suction chamber 13*a*.

The compressor of FIG. 6 has a suction muffler 39. The suction muffler 39 is defined on top of the cylinder blocks 12 and the rear housing 13. The suction muffler 39 is connected to the suction chamber 13*a* by a suction passage 40 and is connected to a suction pipe (not shown).

The embodiment of FIG. 6 has the following advantages.

As in the first embodiment, a high frequency component of the suction pulsation, which is generated by vibration of the suction valve flaps 14*c*, is suppressed by the cooperation of the extended suction ports 14*a* and the suction chamber 13*a*.

The passages 34 are integrally formed with the rear housing 13. This eliminates the necessity for separate parts for forming the passages 34. In other words, the high frequency component of the suction pulsation is suppressed by a simple construction.

The passages 34 are defined by the grooves 37 formed on the rear housing 13 and the gasket 38. Therefore, the passages 34 are formed without increasing the number of parts in the compressor thereby simplifying the compressor construction.

The grooves 37 are formed when molding the rear housing 13. The passages 34 are formed by fastening the rear housing 13, the valve plate 14 and the gasket 38 to one another. In other words, the passages 34 are formed without machining the rear housing 13.

The extended suction ports 14*a* and the suction chamber 13*a* alone effectively suppress the high frequency component of the suction pulsation. Therefore, even if the volume of the suction muffler 39 is small, the high frequency component of the suction pulsation is effectively suppressed by the extended suction ports 14*a*, the suction chamber 13*a* and the suction muffler 39.

A double-headed piston type compressor according to a third embodiment will now be described with reference to FIG. 7.

A front cylinder block 41 and a rear cylinder block 42 are secured to each other. A front housing 44 is secured to the front end face of the front cylinder block 41 with a valve plate 43 in between. A rear housing 45 is secured to the rear end face of the rear cylinder block 42 with a valve plate 43 in between.

Each valve plate 43 has suction ports 43*a* and discharge ports 43*b*. Each suction port 43*a* has a suction valve flap 43*c* and each discharge port 43*b* has a discharge valve flap 43*d*. Gaskets 46 are located between the front housing 44 and the valve plate 43 and between the rear housing 45 and the valve plate 43. Each gasket 46 includes retainers 46*a* for defining the opening amount of the corresponding discharge valve flap 43*d*.

The front housing 44 and the rear housing 45 have suction chambers 44*a*, 45*a*. Discharge chambers 44*b*, 45*b* are defined about the suction chambers 44*a*, 45*a* in the front and rear housings 45.

Aligned pairs of cylinder bores 41*a*, 42*a* are defined in the cylinder blocks 41, 42. A double-headed piston 47 is housed in each pair of cylinder bores 41*a*, 42*a*.

A crank chamber 49 is defined between the cylinder blocks 41, 42. The cylinder block 41, 42 have aligned shaft holes. A drive shaft 50 is rotatably supported in the shaft holes by radial bearings 51. The shaft 50 is operably coupled to an external drive source such as a vehicle engine by a clutch mechanism (not shown). Connection of the clutch mechanism transmits the drive force of the external drive source to the drive shaft 50 and rotates the shaft 50.

A swash plate 52 is fixed to the rotary shaft 50 and is located in the crank chamber 49. The swash plate 52 is also coupled to the central part of each piston 47 with a pair of semispherical shoes 53. The swash plate 24 is rotated by the rotary shaft 17. The boss of the swash plate 52 is supported between the cylinder blocks 41, 42 with a pair of thrust bearings 54 in between. Rotation of the swash plate 52 is transmitted to the pistons 47 through the shoes 53 and is converted into linear reciprocation of each piston 53 in the associated pair of the cylinder bores 41*a*, 42*a*.

The crank chamber 49 is connected to the suction chambers 44*a*, 45*a* by suction passages 55 defined in the cylinder blocks 41, 42. The crank chamber 49 is also connected to an external refrigerant circuit through an inlet (not shown) formed in the cylinder blocks 41, 42. The discharge chambers 44*b*, 45*b* are connected to the external refrigerant circuit by discharge passages 56 and an outlet (not shown) formed in the housings 44, 45.

Each gasket 46 has projections 57 extending toward the suction chambers 44*a*, 45*a*. Each projection 57 corresponds to one of the suction ports 43*a* and includes an extension passage 58. The passages 58 are parallel to the axis if the drive shaft 50. Each passage 58 serves to extend the corresponding suction port 43*a* and communicates with the suction chamber 44*a*, 45*a*.

The operation of the above double-headed piston type compressor will now be described.

When the drive shaft 50 is rotated by the external drive source, the swash plate 52 is rotated integrally with the shaft 50. The rotation of the swash plate 52 is converted into linear reciprocation of the pistons 47 in the cylinder bores 41*a*, 42*a* by the shoes 53. The reciprocation of each piston 47 draws refrigerant gas into the crank chamber 49 through the inlet. The gas in the crank chamber 49 is then led to the front and rear suction chambers 44*a*, 45*a* by the suction passages 55. The gas in the suction chambers 44*a*, 45*a* is then drawn into the cylinder bores 41*a*, 42*a* while causing the suction valve flaps 43*c* to flex to an open position. The gas in the cylinder bores 41*a*, 42*a* is compressed until its pressure reaches a certain level. The compressed gas causes the discharge valve flap 43*d* to flex to open and is discharged to the discharge chambers 44*b*, 45*b* through the corresponding discharge port 43*b*. The discharge passage 56 leads the gas in the discharge chambers 44*b*, 45*b* to the external refrigerant circuit (not shown).

Figure 7:
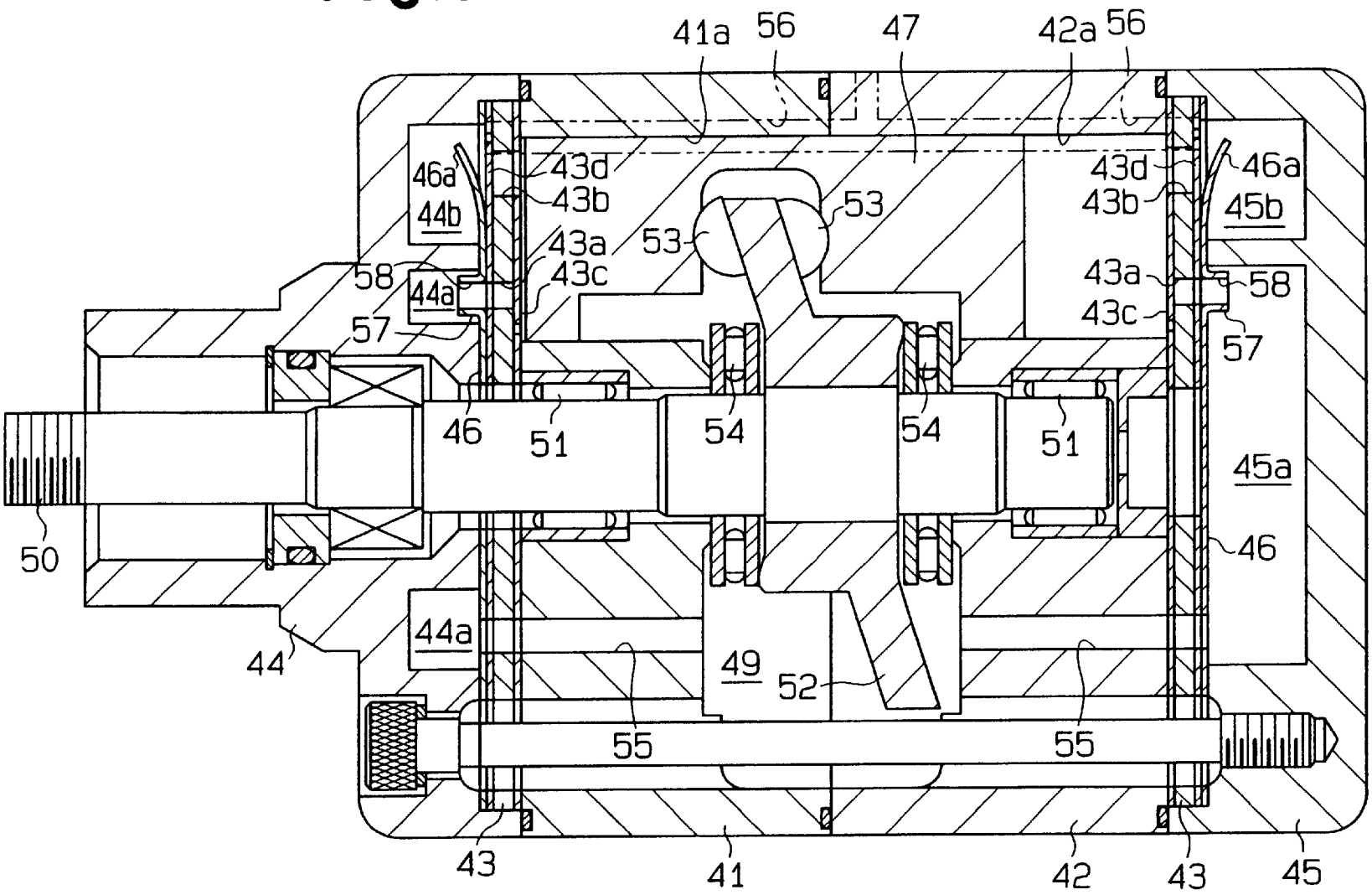
FIG. 7 is a cross-sectional view illustrating a compressor according to a third embodiment.

The embodiment of FIG. 7 has the following advantages.

As in the first embodiment, the suction ports 43*a* are extended by the passages 58. The end of each passage 58 communicates with the suction chamber 44*a*, 45*a*. Therefore, when suction pulsation is generated by vibration of the suction valve flaps 43*c*, high frequency component of the pulsation is suppressed by the cooperation of the extended suction ports 43*a* and the suction chambers 44*a*, 45*a*.

The extension passages 58 are formed in the projections 57, which are part of the valve plates 43. This construction extends the suction ports 43*a* without increasing the number of parts thereby simplifying the construction of the compressor.

A fourth embodiment of the present invention will now be described with reference to FIGS. 8 and 9. The differences from the third embodiment will mainly be discussed below, and like or the same reference numerals are given to those components that are like or the same as the corresponding components of the third embodiment. Although the explanation will be given only for the rear housing 45, the front housing 44 has the same construction as the rear housing 45.

Figure 9:
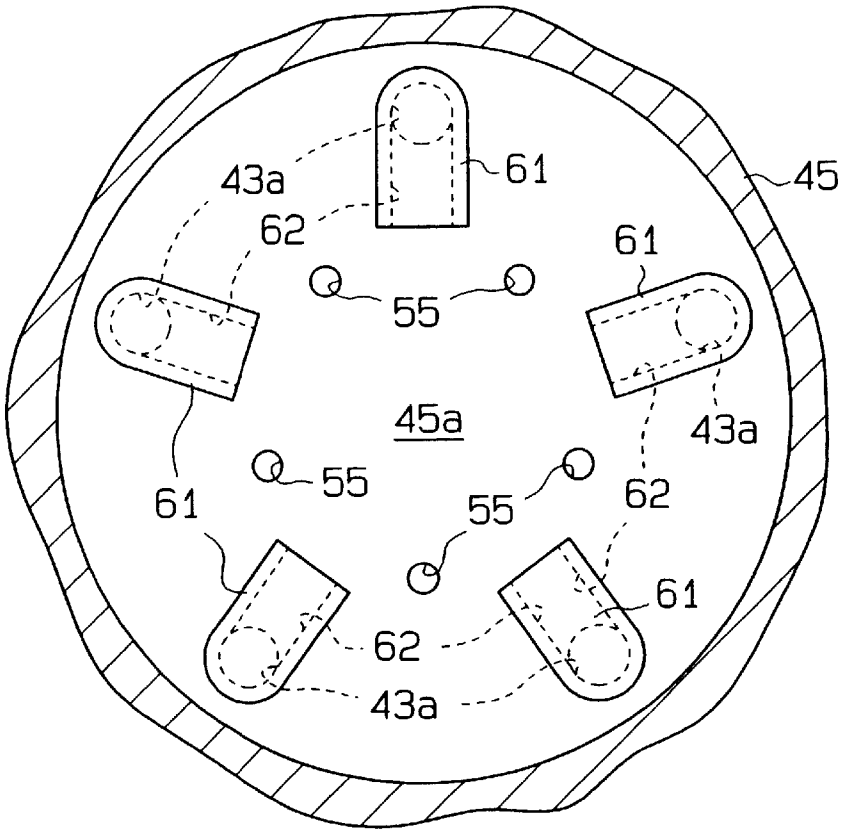
FIG. 9 is a cross-sectional view taken along line 9—9 of FIG. 8.
Figure 8:
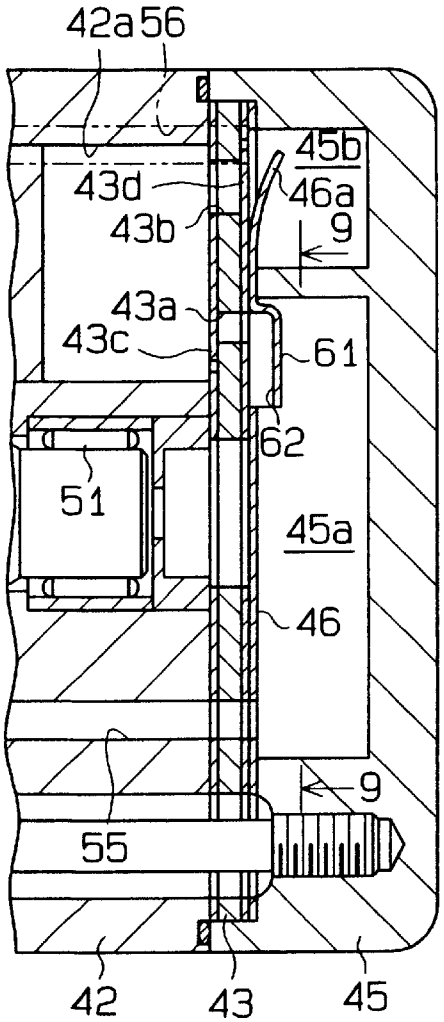
FIG. 8 is an enlarged partial cross-sectional view illustrating a compressor according to a fourth embodiment.

The compressor of FIGS. 8 and 9 includes a gasket 46 located between a valve plate 43 and a rear housing 45. The gasket 46 includes bulges 61, each of which corresponds to one of the suction ports 43*a*. Each bulge 61 and the valve plate 43 define an extension passage 62. Each passage 62 communicates with and extends the corresponding suction port 43*a*. The passages 62 are arranged radially toward the center of the rear housing 45 and open to the suction chamber 45*a*.

The embodiment of FIGS. 8 and 9 has the following advantages.

As in the first embodiment, cooperation of the extended suction ports 43*a* and the suction chamber 45*a* suppresses a high frequency component of the suction pulsation. The extension passages 62 are formed in the gasket 46. Therefore, as in the embodiment of FIG. 7, the compressor of FIGS. 8 and 9 has extended the suction ports 43*a* without having an increased number of parts thereby simplifying the construction of the compressor.

The bulges 61 extend along the valve plate 43 and do not protrude axially toward the suction chamber 45*a*. Thus, the suction chamber 45 need not be extended in the axial direction of the compressor for accommodating the bulges 61. This reduces the size of the rear housing 45.

A fifth embodiment of the present invention will now be described with reference to FIGS. 10 and 12. The differences from the third embodiment will mainly be discussed below, and like or the same reference numerals are given to those components that are like or the same as the corresponding components of the third embodiment. Although a description will be given only for the rear housing 45, the front housing 44 has the same construction as the rear housing 45.

A gasket 46 is held between the valve plate 43 and a bulkhead 66 of the rear housing 45. The gasket 46 includes bulges 65, each of which corresponds to one of the suction ports 43*a*. Each bulge 61 extends arcuately along the gasket 46 and parallel to the bulkhead 66. Each bulge 61 and the valve plate 43 define a pair of extension passages 68. Each pair of the passages 68 communicates with and extends the corresponding suction ports 43*a*. Also, each pair of the passages 68 communicates with the suction chamber 45*a* at openings 67 defined at their ends. Refrigerant gas is introduced to each suction port 43*a* from the suction chamber 45*a* through the corresponding pair of the passages 68.

Figure 12:
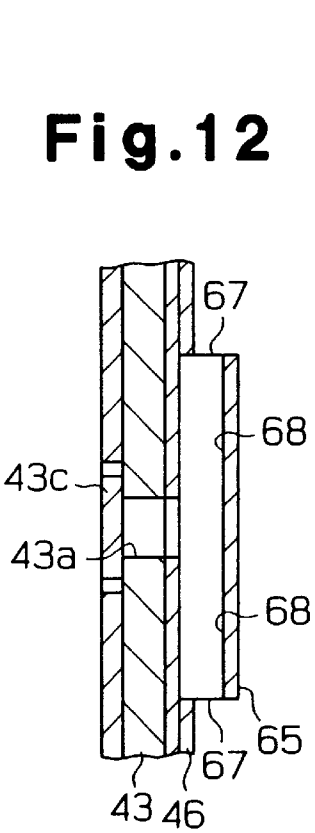
FIG. 12 is a cross-sectional view taken along line 12—12 of FIG. 11.
Figure 11:
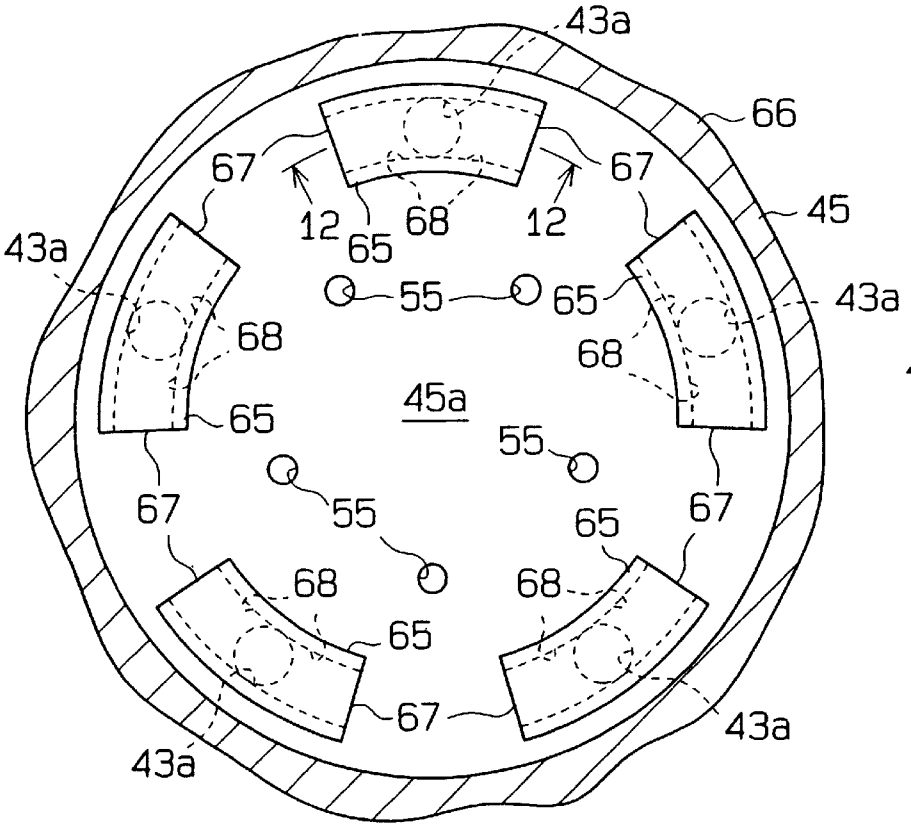
FIG. 11 is a cross-sectional view taken along line 11—11 of FIG. 10.
Figure 10:
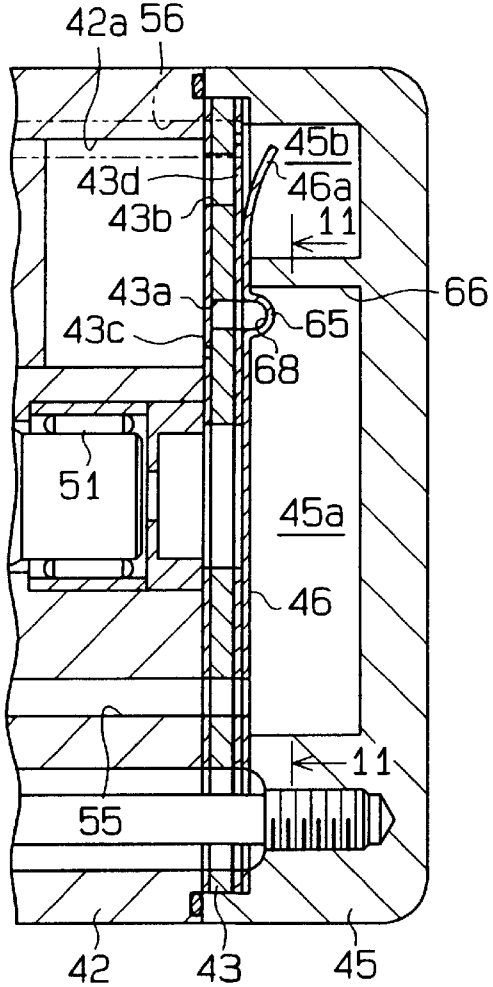
FIG. 10 an enlarged partial cross-sectional view illustrating a compressor according to a fifth embodiment.

The embodiment of FIGS. 10–12 has the following advantages.

As in the first embodiment, cooperation of the extended suction ports 43*a* and the suction chamber 45*a* suppresses a high frequency component of suction pulsation of the compressor. The extension passages 68 are formed in the gasket 46. Therefore, as the embodiment FIG. 7, the embodiment of FIGS. 10 to 12 extends the suction ports 43*a* without increasing the number of parts thereby simplifying the construction of the compressor. Further, like the compressor of the embodiment FIGS. 8 and 9, the construction of the compressor of FIGS. 10 to 12 reduces the size of the rear housing.

In the embodiment of FIGS. 10 to 12, gas is introduced to each suction port 43*a* through two passages 68. This construction smoothly introduces gas to the suction ports 43*a* thereby reducing pressure loss when drawing gas from the external refrigerant circuit. If the suction chamber 45*a* has a small volume, forming extension passages that protrude toward the chambers 44*a*, 45*a* increases suction pressure loss. However, the extension passages 68 of FIGS. 10–12 do not extend axially toward the suction chambers 44*a* but extend along the gasket 46. Thus, the passages 68 effectively reduce the suction pressure loss.

It should be apparent to those skilled in the art that the present invention may be embodied in many other specific forms without departing from the spirit or scope of the invention. Particularly, it should be understood that the invention may be embodied in the following forms.

In the embodiment of FIGS. 10 to 12, each pair of passages 68 has a circular shape. However, the pairs of passage 68 may be L, V, U, T, Y or X-shaped with the corresponding port 43*a* located in its center. In this case, the openings 67 are formed at the end of each passage 68.

T- or Y-shaped passages 68 have three openings 67 for a single suction port 43*a*. X-shaped passages 68 have four openings 67 for a single suction port 43*a*. These constructions therefore further facilitates drawing of gas thereby reducing pressure losses when drawing gas from the external refrigerant circuit.

In the embodiments of FIGS. 1 to 12, the suction chambers 13*a*, 44*a*, 45*a* may be omitted.

In the embodiment of FIG. 6, the gasket 38 may be omitted and extension passages 34 may be defined by the grooves 37 and the valve plate 14.

In the embodiment of FIG. 7, the gasket 46 may be omitted. In this case, the valve plates 43 are formed such that parts surrounding the ports 43*a* protrude toward the suction chambers 44*a*, 45*a* and an extension passage is formed in each passage 58.

In the embodiment of FIGS. 10 to 12, the cylinder 33 of the embodiment of FIGS. 1 to 3 may located in the suction chamber 45*a* for extending the suction port 43*a* by the passages 34 in the cylinder 33.

In the embodiment of FIGS. 10 to 12, extension passages may be formed in the manner of the embodiment of FIG. 6. That is, the extension passages may be defined by grooves formed in the rear housing 45 and either the valve plate 43 or the gasket 46

The construction, that is, the extended suction ports 14*a* and the suction chamber 13*a*, of the embodiments of FIGS. 1 to 6 may be employed in double-headed piston type compressors.

The construction, that is, the extended suction ports 44*a*, 45*a* and the suction chamber 45*a*, of the embodiments of FIGS. 7 to 12 may be employed in single-headed piston type compressors.

The present invention may be embodied in other types of compressors such as fixed displacement compressors having single-headed pistons, variable displacement compressors having double-headed pistons, wobble plate type compressors, wave cam plate type compressors.

Therefore, the present examples and embodiments are to be considered as illustrative and not restrictive and the invention is not to be limited to the details given herein, but may be modified within the scope and equivalence of the appended claims.

What is claimed is:

1. A compressor having a cylinder bore in a housing, said cylinder bore being arranged to receive gas from a suction port, said compressor comprising:

passage means having a length and communicating with the suction port, said passage means being adjacent to the suction port, to thereby effectively extend the length of the suction port, and a suction valve provided on the suction port, whereby gas pulsation as would otherwise result from the gas flow through the suction valve is absorbed within the passage means.

2. The compressor as set forth in claim 1, further comprising:

an outlet passage for allowing the gas to flow outside the compressor; and a chamber disposed between the passage means and the outlet passage.

3. The compressor as set forth in claim 2, further comprising:

a valve plate including the suction port, said valve plate being positioned on the housing; and said passage means being separate from, but attached within the housing.

4. The compressor as set forth in claim 2, further comprising:

a valve plate including the suction port, said valve plate being positioned on the housing; and said passage means being formed by and between the valve plate and the housing.

5. The compressor as set forth in claim 4, wherein said passage means includes a groove provided on the housing.

6. The compressor as set forth in claim 3, further comprising:

a gasket disposed between the housing and the valve plate; and a protruding portion provided on the gasket, said protruding portion including the passage means.

7. A compressor having a cylinder bore in a housing, said cylinder bore being arranged to receive gas from a suction port and to discharge the gas out of the cylinder bore through a discharge port, said compressor comprising:

a suction valve provided on the suction port; and passage means having a length and communicating with the suction port, said passage means being adjacent to the suction port to effectively extend the length of the suction port so that gas pulsation as would otherwise result when gas is flowing through the suction valve is absorbed within the passage means.

8. The compressor as set forth in claim 7, further comprising:

an outlet passage communicating with the discharge port to allow the gas to flow outside the compressor; and a chamber disposed between the passage means and the outlet passage.

9. The compressor as set forth in claim 8, further comprising:

a valve plate including the suction port, said valve plate being positioned on the housing; and said passage means being separate from, but attached within the housing.

10. The compressor as set forth in claim 8, further comprising:

a valve plate including the suction port, said valve plate being positioned on the housing; and said passage means being formed by and between said valve plate and the housing.

11. The compressor as set forth in claims 9, wherein said passage means includes a groove provided on the housing.

12. The compressor as set forth in claim 8, further comprising:

a gasket disposed between the housing and the valve plate; and a protruding portion provided on the gasket, said protruding portion including the passage means.

13. A compressor having a cylinder bore in a housing, said cylinder bore being arranged to receive gas from a suction port and discharge the gas out of the compressor through a discharge port, said compressor comprising:

a suction valve provided on the suction port; and absorbing means for absorbing gas pulsation when the gas flows through the suction valve, said absorbing means including passage means having a length and communicating with the suction port to effectively extend the length of the suction port.

14. The compressor as set forth in claim 1 further comprising a housing including a front housing, a cylinder block and a rear housing, wherein said cylinder bore is formed in the cylinder block and said passage means is disposed within the rear housing.

15. The compressor as set forth in claim 1 further comprising a housing including a front housing, a cylinder block and a rear housing, wherein said cylinder block has a plurality of said cylinder bores, wherein a respective plurality of said suction ports is provided for said plurality of cylinder bores, and one of said passage means is provided for each of the respective cylinder bores.

16. The compressor as set forth in claim 14 further comprising:

a valve plate including the suction port, said valve plate being positioned on the cylinder block; and said passage means being located on the valve plate.

* * * * *

UNITED STATES PATENT AND TRADEMARK OFFICE

CERTIFICATE OF CORRECTION

PATENT NO. : 6,045,342
DATED : April 4, 2000
INVENTOR(S) : Kazuya Kimura

It is certified that error appears in the above-identified patent and that said Letters Patent is hereby corrected as shown below:

Title page:
Item [56] References Cited: Add to "U.S. Patent Documents"

| | | | |
|---|---|---|---|
| -- | 4,761,119 | 8/1988 | Nomura et al. -- |
| -- | 3,664,769 | 5/1972 | Knudsen et al. -- |
| -- | 3,504,762 | 4/1970 | Valbjorn et al." |

Add "Foreign Documents"

| | | | |
|---|---|---|---|
| -- | DE43 42 299 A1 | 1/1995 | Germany -- |
| -- | DE36 05 936A1 | 1/1986 | Germany -- |
| -- | 1 601 860 | 12/1971 | Germany -- |
| -- | 1 501 030 | 10/1969 | Germany -- |
| -- | 1 221 393 | 7/1966 | Germany -- |
| -- | 972 552 | 4/1956 | Germany -- |

Change Patent No. "5,533,870" to -- 5,553,870 --.

Column 10,
Lines 49-50, after "suction port" do not start a new paragraph, continue with "so that gas pulsation…".

Column 11,
Line 5, change "claims" to -- claim --.

Signed and Sealed this

Ninth Day of October, 2001

*Attest:*

Nicholas P. Godici

*Attesting Officer*

NICHOLAS P. GODICI
*Acting Director of the United States Patent and Trademark Office*